United States Patent [19]

Yokoi et al.

[11] Patent Number: 4,838,535

[45] Date of Patent: Jun. 13, 1989

[54] SHEET FEEDING DEVICE WITH DETACHABLE HOLDER MEANS FOR THICK CUT SHEETS

[75] Inventors: Takeshi Yokoi, Kagamigahara; Toshiki Morita, Toyoake, both of Japan

[73] Assignee: Brother Kogyo Kabushiki Kaisha, Nagoya, Japan

[21] Appl. No.: 10,671

[22] Filed: Feb. 4, 1987

[30] Foreign Application Priority Data

Feb. 6, 1986 [JP] Japan ..... 61-16003
Oct. 15, 1986 [JP] Japan ..... 61-244935

[51] Int. Cl.[4] ..... B65H 3/06

[52] U.S. Cl. ..... 271/22; 271/127; 271/171

[58] Field of Search ..... 271/3, 9, 22, 127, 171

[56] References Cited

U.S. PATENT DOCUMENTS 3,989,236 11/1976 Komori ..... 271/127 X
4,017,181 4/1977 Komaba ..... 271/127 X
4,131,274 12/1978 Sue ..... 271/9
4,147,341 4/1979 Wurscher ..... 271/127 X

FOREIGN PATENT DOCUMENTS 2131352 6/1984 United Kingdom .
2141111 12/1984 United Kingdom .

*Primary Examiner*—Richard A. Schacher
*Attorney, Agent, or Firm*—Jones, Tullar & Cooper

[57] ABSTRACT

Disclosed is a sheet feeding device for printers and the like, which comprises a detachable holder for thick cut sheets. In this device, thin ordinary cut sheets, supported in a pile by paper supporting means, are delivered one by one in a sheet feeding direction by feed rollers, which are in contact with the uppermost one of the sheets. In feeding relatively thick cut sheets, such as postal cards and other cards, the holder carrying the sheets thereon is detachably mounted on the supporting structure. The holder includes a supporting member for supporting the leading ends of the thick cut sheets, with respect to the sheet feeding direction. The supporting member has a slanting or curved guide surface. As the feed rollers rotate in contact with the uppermost one of the thick cut sheets, the sheets are delivered, sliding on the guide surface.

17 Claims, 11 Drawing Sheets

SHEET FEEDING DEVICE WITH DETACHABLE HOLDER MEANS FOR THICK CUT SHEETS

BACKGROUND OF THE INVENTION

The present invention relates to a sheet feeding device adapted for use with printers or copying machines of various types, and serving to deliver paper sheets one by one to a predetermined position, and more specifically, to a sheet feeding device capable of feeding relatively small, thick cut sheets, such as postal cards and other cards, as well as thin ordinary paper sheets.

Conventionally, sheet feeding devices, used with various printers and copying machines, are adapted to feed thin cut sheets, such as printing sheets and copying sheets for general use. In these conventional feeding devices, separating claws are attached to a paper holder, as means for supporting thin cut sheets in a pile. The separating claws are located corresponding to two corner portions of each cut sheet on the leading end side thereof, with respect to a sheet feeding direction. When feed rollers rotate to deliver the thin cut sheets, the claws positively bend the corner portions of the leading end of each sheet, thereby separating the uppermost one of the sheets from the remainder. Thus, the thin cut sheets can securely be fed one by one.

The paper holder of the prior art sheet feeding devices of this type can be used only for thin paper sheets. Practically, therefore, it is difficult for those feeding devices to feed relatively rigid, thick cut sheets, such as postal cards, for printing or copying operation. More specifically, if the paper holder of one such conventional feeding device is used to feed thick cut sheets, the corner portions of the leading end of each sheet can hardly be bent by the separating claws. After all, the devices cannot feed thick cut sheets with ease.

A feeding mechanism has recently been proposed which is used exclusively for the feed of thick cut sheets. This mechanism cannot, however, be used without replacing a thin paper feeding mechanism. Such an arrangement entails high manufacturing cost, and requires troublesome work for the replacement.

SUMMARY OF THE INVENTION

The present invention has been contrived in consideration of these circumstances, and is intended to provide a sheet feeding device of a compact design, which permits mounting of a feeding mechanism for thick cut sheets, without requiring troublesome replacement with a feeding mechanism for thin cut sheets, and which is easy to operate, and does not require any exclusive drive means for thick paper feed, thus enjoying reduced manufacturing cost.

In order to achieve the above object, a sheet feeding device according to the present invention is provided with thick paper holder means for holding thick cut sheets. In feeding thick cut sheets, the holder means is detachably mounted on supporting means for thin cut sheets. The holder means is disposed between the supporting means and sheet feed roller means, which serves for the feed of both thin and thick cut sheets. The holder means includes a supporting member which engages the leading ends of thick cut sheets, with respect to a sheet feeding direction, thereby holding the sheets in a pile. The supporting member is formed with a guide surface extending across the sheets. As the feed roller means rotates, the leading end of the uppermost one of the thick cut sheets is slid out along the guide surface. Thus, the thick cut sheets are fed securely with smoothness.

According to an aspect of the invention, backup means for pressing the thin cut sheets toward the feed roller means is used also for the thick cut papers in the mounted thick paper holder means. Thus, the sheet feeding device is further simplified in construction.

In the arrangement described above, the thick paper holder means is formed of a rectangular frame adjusted to the size of the thick cut sheets to be fed. The frame is mounted on the thin paper supporting means, and held bilaterally between a pair of slidable press members for holding the thin cut sheets on the supporting means. Thus, the frame is restrained from moving from side to side, and can therefore be positioned definitely.

According to another aspect of the invention, the holder means is formed of a pair of sheet receiving members detachably attached to their corresponding guide members, which constitutes the thin paper supporting means. Accordingly, the sheet receiving members, along with the paired guide members, can move relatively across the sheets, thus permitting use of thick cut sheets of different sizes.

BRIEF DESCRIPTION OF THE DRAWINGS

These and other aspects and advantages of the present invention will be more completely described below with reference to the accompanying drawings, in which.

DETAILED DESCRIPTION OF THE PREFERRED EMBODIMENTS

A sheet feeding device of the present invention is applied to a printer which is adapted to be connected, when in use, to a computer, word processor, etc.

Referring now to FIGS. 1 to 11, a sheet feeding device according to a first embodiment of the invention will be described in detail.

Figure 1:
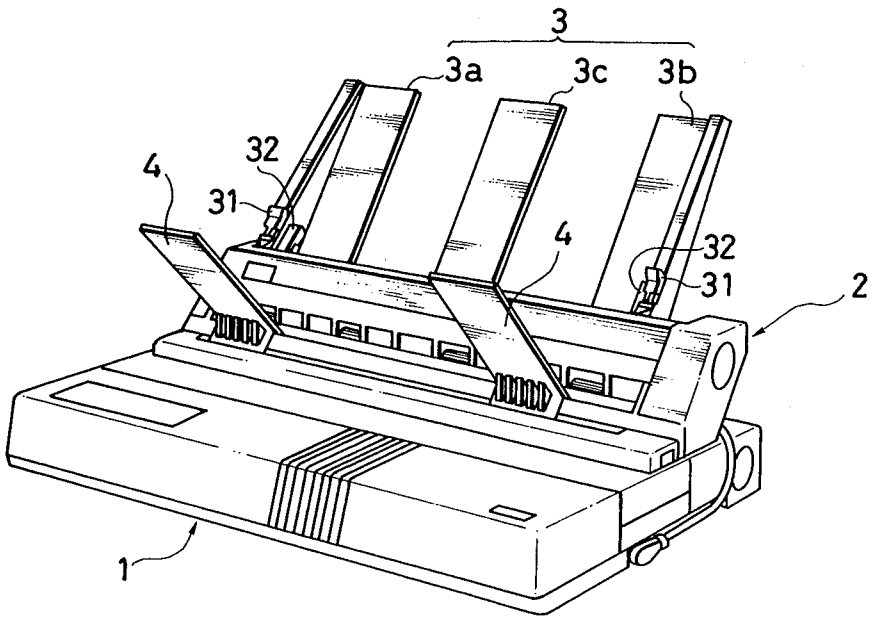
FIG. 1 is an external perspective view of a printer using a sheet feeding device according to a first embodiment of the present invention, with its thick paper holder means removed.

In the state shown in FIG. 1, the sheet feeding device 2 is prepared to feed thin ordinary cut sheets. In the state shown in FIG. 2, the device 2 is ready to feed thick cut sheets, such as postal cards.

Figure 3:
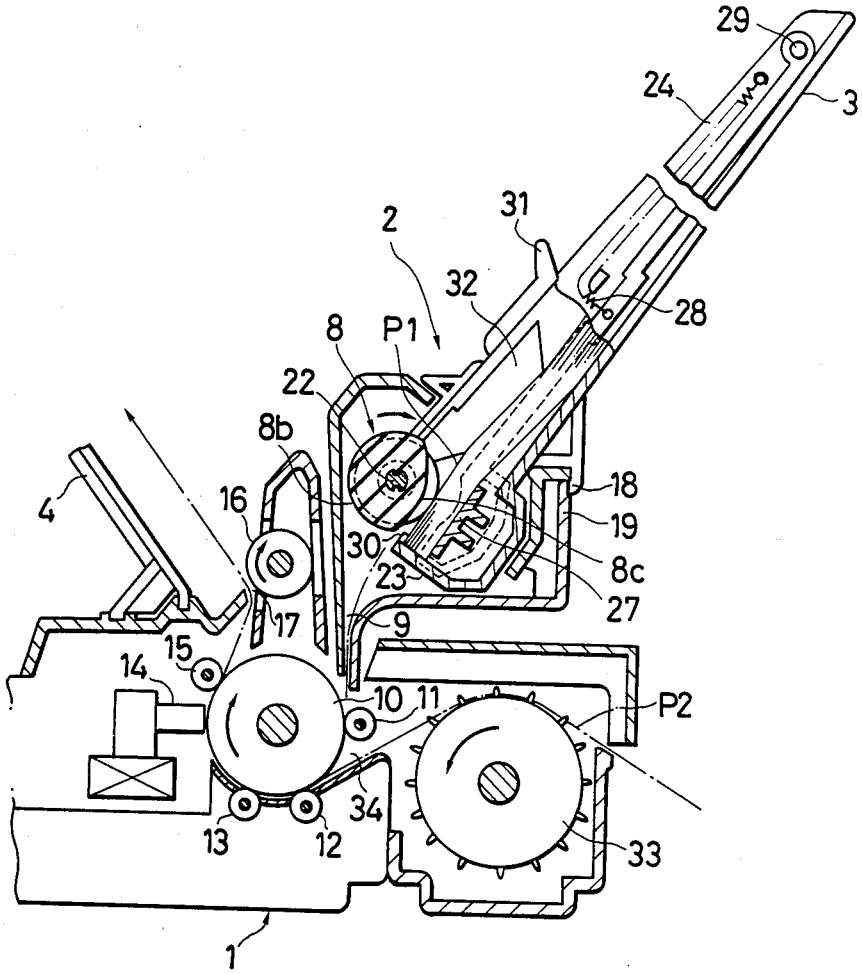
FIG. 3 is an enlarged vertical sectional view showing a principal part of FIG. 1.
Figure 4:
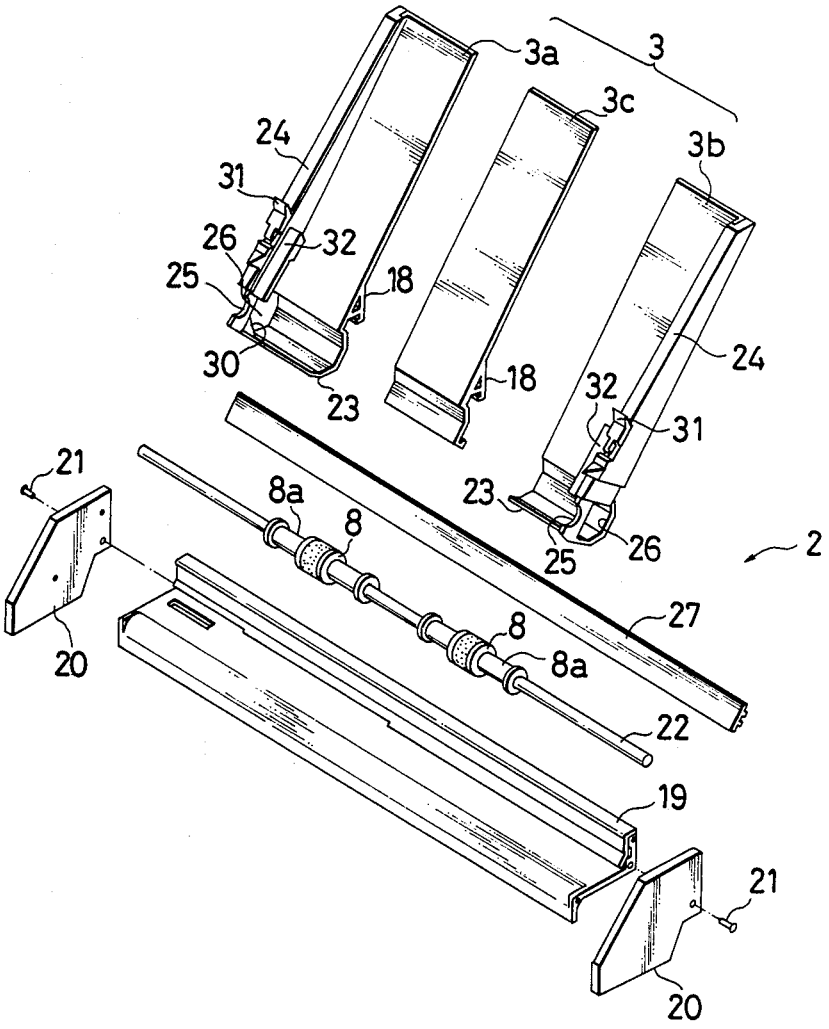
FIG. 4 is an exploded perspective view of the sheet feeding device shown in FIG. 1, with the thick paper holder means removed.

Referring first to FIGS. 1, 3 and 4, there will be described in brief the relationship between the arrangement of a printer and the sheet feeding device of the first embodiment, which is in the state for the feed of thin ordinary cut sheets.

As shown in FIG. 1, the sheet feeding device 2 is attached to the rear portion of the top face of a printer housing 1. The device 2 is provided with a pair of side paper holders 3*a* and 3*b*, constituting thin paper supporting means 3, and a center paper holder 3*c*located between the holders 3*a* and 3*b*. The paper holders 3*a*, 3*b* and 3*c* are inclined with some gradient. A pair of slanting stackers 4 are attached to the front portion of the printer housing 1. As shown in FIG. 3, unprinted, thin cut sheets P1 are stacked in a pile on the paper holders 3*a*, 3*b* and 3*c*, so as to lean against them.

In the printer described above, the thin cut sheets P1 on the paper holders 3*a*, 3*b* and 3*c* or supporting means 3 are fed one by one in a sheet feeding direction, as indicated by the chain-line arrow in FIG. 3, getting through a feeding aperture 9 to pass between a platen 10 and a pinch roller 11, as feed rollers 8 rotate. As the pinch roller 11 and guide rollers 12 and 13 rotate, following the rotation of the platen 10, each sheet P1 is delivered to a printing position in which a print head 14 is located. After undergoing printing by means of the print head 14, the sheet P1 is transported in a discharging direction, as indicated by the chain-line arrow in FIG. 3, to be discharged through an exit aperture 17 onto the stackers 5 and 6, as the platen 10 and a paper bail roller 15 rotate cooperatively, and as an exit roller 16 rotates separately. Thus, the cut sheets P1 are stacked and held in a pile on the stackers 5 and 6.

As shown in FIG. 3, an engaging portion 18, on the back of the lower end portion of the supporting means 3, is supported on a supporting frame 19 of the printer housing 1 so as to be slidable in the axial direction of the platen 10. As shown in FIG. 4, the supporting frame 19 is fixed between a pair of side frames 20 of the printer housing 1 by means of screws 21. The feed rollers 8, which are two in number, are axially slidably arranged on a shaft 22, which extends between the side frames 20 for positive rotation.

A supporting piece 23 is formed on the lower end portion of each of the paper holders 3*a* and 3*b* of the supporting means 3. The leading ends of the thin cut sheets P1, with respect to the sheet feeding direction, abut against the supporting pieces 23. Also, each paper holder is formed with a side plate 24, which serves to guide its corresponding side edge of each cut sheet P1. An outside boss portion 8*a* of each feed roller 8 is relatively rotatably fitted in each corresponding semicircular recess 25, which is formed in the lower end portion of the top edge of the side plate 24 of each paper holder 3*a* or 3*b*. As the paper holders 3a and 3b slide in the axial direction of the shaft 22, the feed rollers 8 slide together with the holders, on the shaft 22.

An opening 26 is formed in the lower end portion of each side plate 24. An elongate backup member 27, as backup means, is fitted in the opening 26, so as to extend in the axial direction of platen 10. The backup member 27 is urged in one direction by a tension spring 28 (FIG. 3), for use as elastic means, which is disposed in the side plate 24 of each paper holder. Thus, the backup member 27 presses the thin cut sheets P1 toward the feed rollers 8, thereby bringing the uppermost one of the sheets P1 into contact with the rollers 8.

A triangular engaging piece 30 is provided at the junction of the lower end portion of the side plate 24 of each paper holder and one end of its corresponding supporting piece. The engaging pieces 30 constitute separating members which engage their corresponding corner portions of the uppermost cut sheet P1 on the leading-end side thereof.

The paired engaging pieces 30 serve to temporarily hold the uppermost cut sheet P1 so that only the uppermost sheet is bent positively by friction from the feed rollers 8, to be separated from the remaining sheets, while the rollers 8 are rotating to feed the sheets P1.

Figure 6:
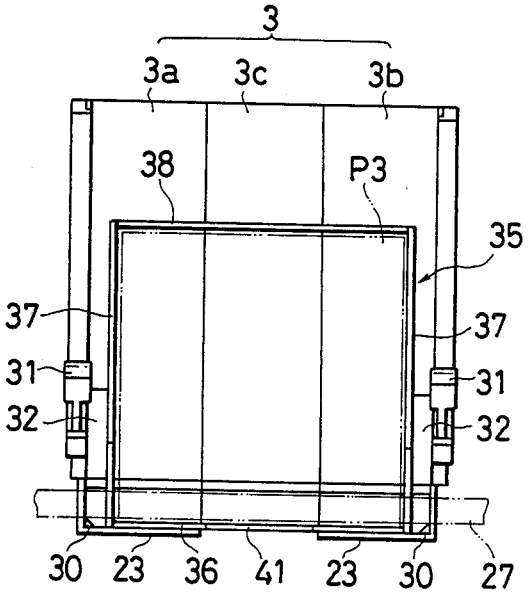
FIG. 6 is a partial front view of the thick paper holder means attached to the printer in the manner shown in FIG. 2.

FIG. 6 shows both of the engaging pieces 30.

One thin cut sheet P1 is delivered from the supporting means 3 to the platen 10 each time the feed rollers 8 make one revolution in the clockwise direction, as indicated by an arrow in FIG. 3. Each roller 8 has an arcuate operative surface 8b, in contact with the pile of sheets P1, and a nonoperative surface 8*c*, which cannot touch the sheets P1. In a nonfeeding state as shown in FIG. 3, each roller 8 is in its original position where the nonoperative surface 8c faces the sheets P1 so that the sheets P1 can be freely inserted into or taken out from the device 2.

In the supporting means 3, an operating lever 31 is attached to each of the paired paper holders 3*a* and 3*b*. The operating levers 31 serve as grip portions which are used to slide the holders 3*a* and 3*b* from side to side. By operating the levers 31, the backup member 27 is shifted against the urging force of the springs 28, with the aid of a suitable transmission mechanism (not shown), to its nonoperative position where the member 27 is at a distance from the feed rollers 8. With the backup member 27 held in the nonoperative position, the cut sheets P1 are inserted into or taken out from the device 2.

In the supporting means 3, moreover, a pair of press members 32 are attached individually to the paper holders 3*a* and 3*b*. The press members 32 bilaterally engage the thin cut sheets P1 on the supporting means 3, thereby preventing the sheets from lifting. The members 32 are supported elastically on the side plates 24 of their corresponding holders 3*a* and 3*b* by means of springs (not shown).

In FIG. 3, numeral 33 designates a sprocket wheel which is disposed in the rear portion of the printer housing 1, so as to be located under the feeding device 2. The sprocket wheel 33 serves to feed a continuous sheet P2 to the platen 10. As the wheel 33 rotates in the direction indicated by the arrow, the continuous sheet P2 is transported past the feeding aperture 34 to the printing position. Then, like the thin cut sheets P1, the sheet P2 is discharged to the outside by the exit roller 16. Selection of the sheet type between the continuous sheet P2 and thin cut sheets P1 is effected as required by an operator's switching operation on the printer.

There will now be described in detail a thick paper holder 35 of the sheet feeding device 2, whereby thick cut sheets P3, such as postal cards, can be fed properly.

Figure 2:
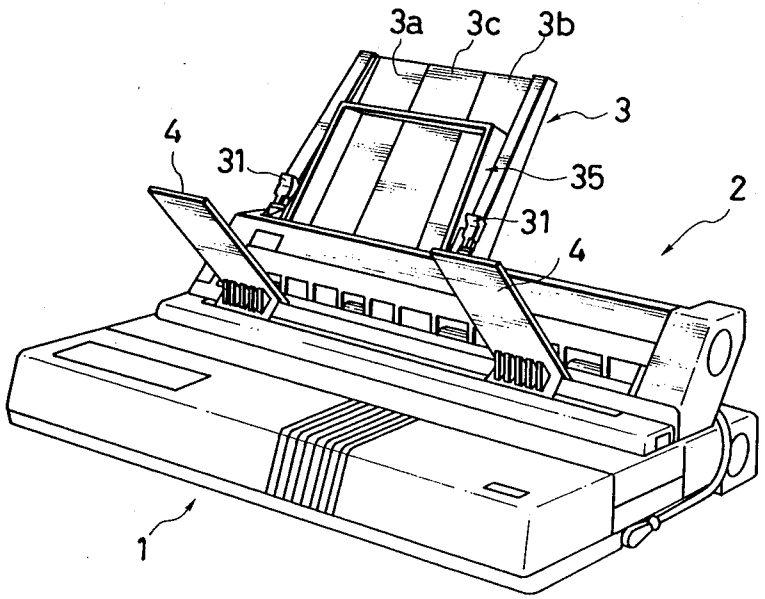
FIG. 2 is an external perspective view of the printer of FIG. 1, with the thick paper holder means attached to the sheet feeding device.
Figure 5:
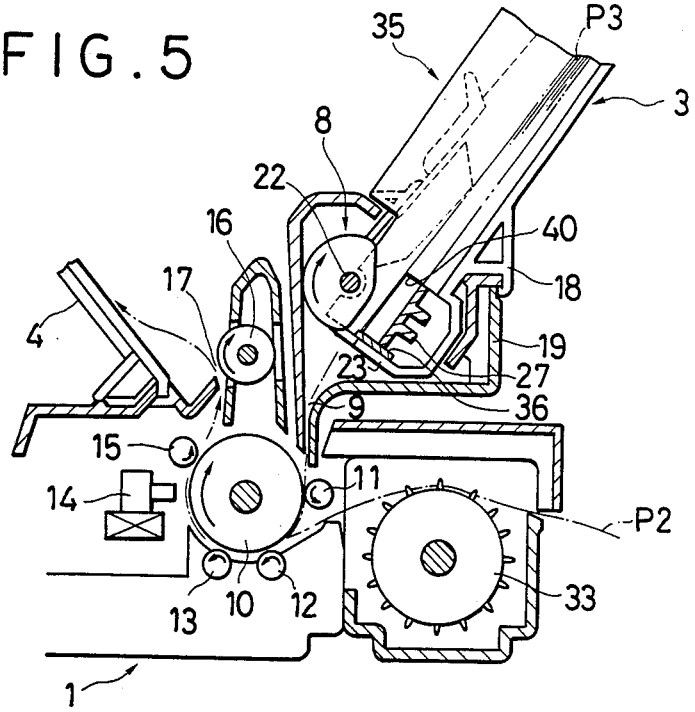
FIG. 5 is an enlarged vertical sectional view, similar to FIG. 3, showing the thick paper holder means attached to the printer.
Figure 7:
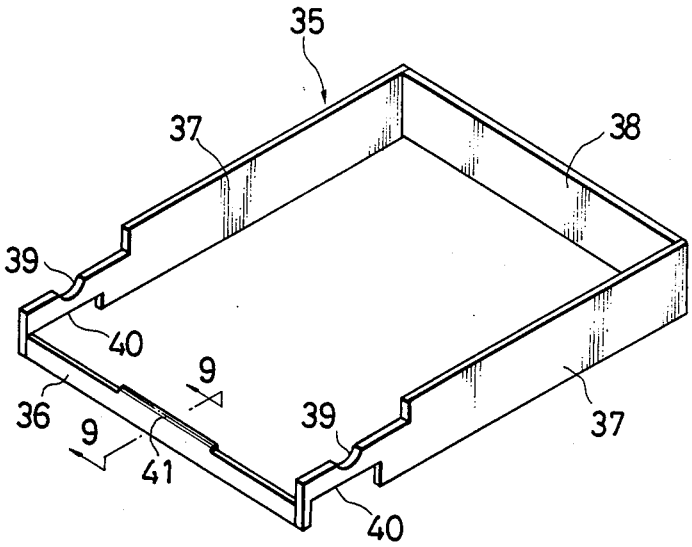
FIG. 7 is an external perspective view of a rectangular frame of the thick paper holder means.

FIGS. 2 and 5 are a perspective view and a sectional view, respectively, showing the principal parts of the printer which is provided with the thick paper holder 35. FIG. 6 is a front view showing the paper holders of the printer, and FIG. 7 is a perspective view of the thick paper holder 35. As seen from these drawings, the thick paper holder 35 has the form of a rectangular frame, including a front supporting member 36 adapted to engage the leading ends of the thick cut sheets P3, with respect to the feeding direction, a pair of side plates 37 for guiding the side edges of the sheets P3, and a coupling plate 38 extending parallel to the supporting member 36.

The suporting member 36 and the respective front end portions of the side plates 37 are recessed vertically from the level of the rear portion of the thick paper holder 35. Thus, the front end portion of the holder 35 can be inserted between the supporting means 3 and the feed rollers 8. When the holder 35 is partially inserted in this manner, it is held in a position such that the supporting member 36 engages the supporting pieces 23 of the paper holders 3*a* and 3*b*.

A semicircular recess 39 is formed in the front end portion of the top edge of each side plate 37. The outside boss portions 8a of the feed rollers 8 are fitted in their corresponding recesses 39, for relative rotation.

A notch 40 is formed in the front end portion of the bottom edge of each side plate 37, so that the backup member 27 is allowed to move for backup motion.

Figure 9:
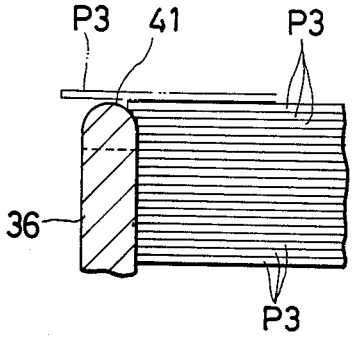
FIG. 9 is an enlarged sectional view of a principal part as taken along line 9—9 of FIG. 7.

A guide surface 41 is formed on the central portion of the top edge of the supporting member 36. As shown in FIG. 9 the guide surface 41 is an arcuate surface.

The thick paper holder 35 is set on the supporting means 3, in the following manner. First, the paper holders 3*a* and 3*b* are slid so that the distance between the press members 32 is substantially equal to the width of the thick paper holder 35. In this embodiment, as shown in FIG. 6, the distance between the members 32 is substantially equal to the width of the holder 35 when the holders 3*a*, 3*b* and 3*c* abut against one another. In this state, the press members 32 are in contact with their corresponding side plates 37 of the holder 35, so that the holder 35 is held tight between the members 32. Then, the holder 35 is inserted between the supporting means 3 and the feed rollers 8 so that the supporting member 36 engages the supporting pieces 23 of the paper holders 3*a*and 3*b*.

As a result, the feed rollers 8 are located adjacent to the front end portion of the thick paper holder 35. Also, the press members 32 serve for horizontal positioning such that the holder 35 is detachably mounted on the supporting means 3, inside the engaging pieces 30 of the paper holders 3*a* and 3*b*.

The thick cut sheets P3 are stacked in a pile on the thick paper holder 35, and are pushed toward the feed rollers 8 by the backup member 27. Thus, the backup member 27 constitutes means for urging the thick cut sheets P3, as well as the thin cut sheets P1, toward the feed rollers 8.

In this state, when the feed rollers 8 are rotated, the uppermost one of the thick cut sheets P3 is delivered forward. At this time, the uppermost sheet P3 is delivered while getting over the curved guide surface 41 of the supporting member 36, as shown in FIG. 5. Thus, the thick cut sheet P3 is separated definitely from its successor, to be delivered singly without fail.

The delivered thick cut sheet P3, as in the case of the thin cut sheet P1, is fed between platen 10 and the pinch roller 11, getting through the feeding aperture 9. As the pinch roller 11 and the guide rollers 12 and 13 rotate, following the rotation of the platen 10, the sheet P3 is delivered to the printing position. After undergoing printing by means of the print head 14, the sheet P3 is discharged through the exit aperture 17 onto the stackers 4 as the platen 10 and the paper bail roller 15 rotate cooperatively, and as the exit roller 16 rotate separately. Thus, the cut sheets P3 are stacked and held in a pile on the stackers 5 and 6.

If the thick paper holder 35 is removed from the supporting means 3 by inversely following the mounting procedure, the thin cut sheets P1 can be set to be fed again.

Figure 10:
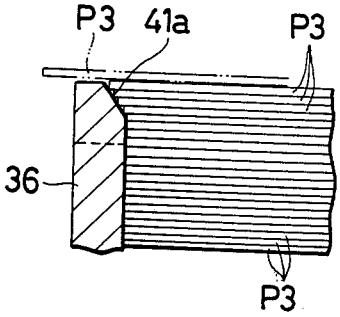
FIG. 10 is an enlarged sectional view showing a modification of the part shown in FIG. 9.

The curved guide surface 41 of the supporting member 36 of the aforementioned embodiment may be replaced with a slanting surface 41*a*, which leans outward or toward the feed rollers 8, with respect to the sheet feeding direction, as shown in FIG. 10. Alternatively, the whole supporting member 36 may be slanted to serve for the slanting surface.

Figure 8:
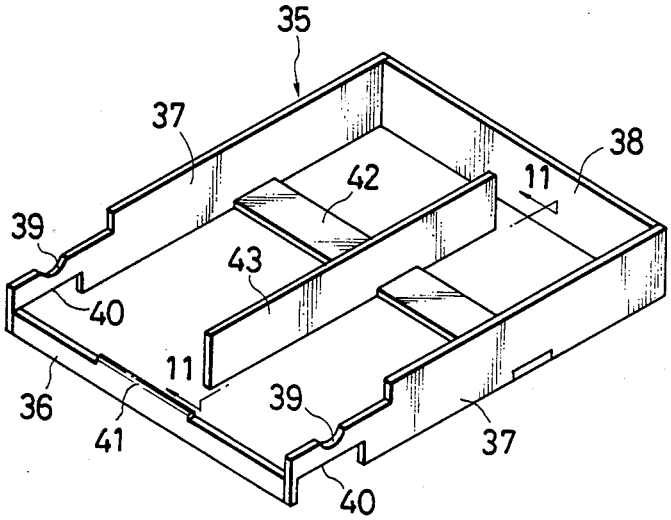
FIG. 8 is an external perspective view of a modification in which a guide plate is added to the frame shown in FIG. 7.
Figure 11:
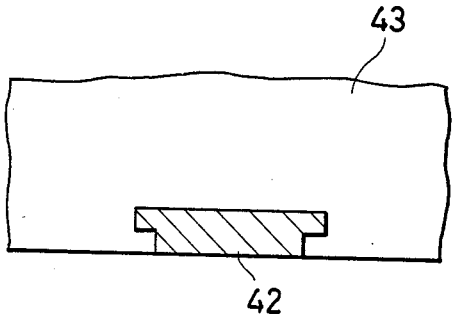
FIG. 11 is an enlarged sectional view of a principal part as taken along line 11—11 of FIG. 8.

As shown in FIGS. 8 and 11, moreover, the thick paper holder 35 may be provided with a cross member 42 and a guide plate 43. The cross member 42 extends between the respective bottom portions of the side plates 37. The guide plate 43 extends parallel to the side plates 37, and its bottom portion engages the cross section 42 so as to be slidable across the sheets. Thus, the thick cut sheets P3 can be guided securely between one of the side plates 37 and the guide plate 43, which can be slid for adjustment according to the sheet size.

Referring now to FIGS. 12 to 17, a second embodiment of the present invention will be described. In the description to follow, like reference numerals are used to designate like portions as included in the first embodiment, for simplicity of illustration. More specifically, these portions are included in the arrangement of the printer housing 1, and the thin paper supporting means 3 in the sheet feeding device 2 mounted on the housing 1.

Figure 12:
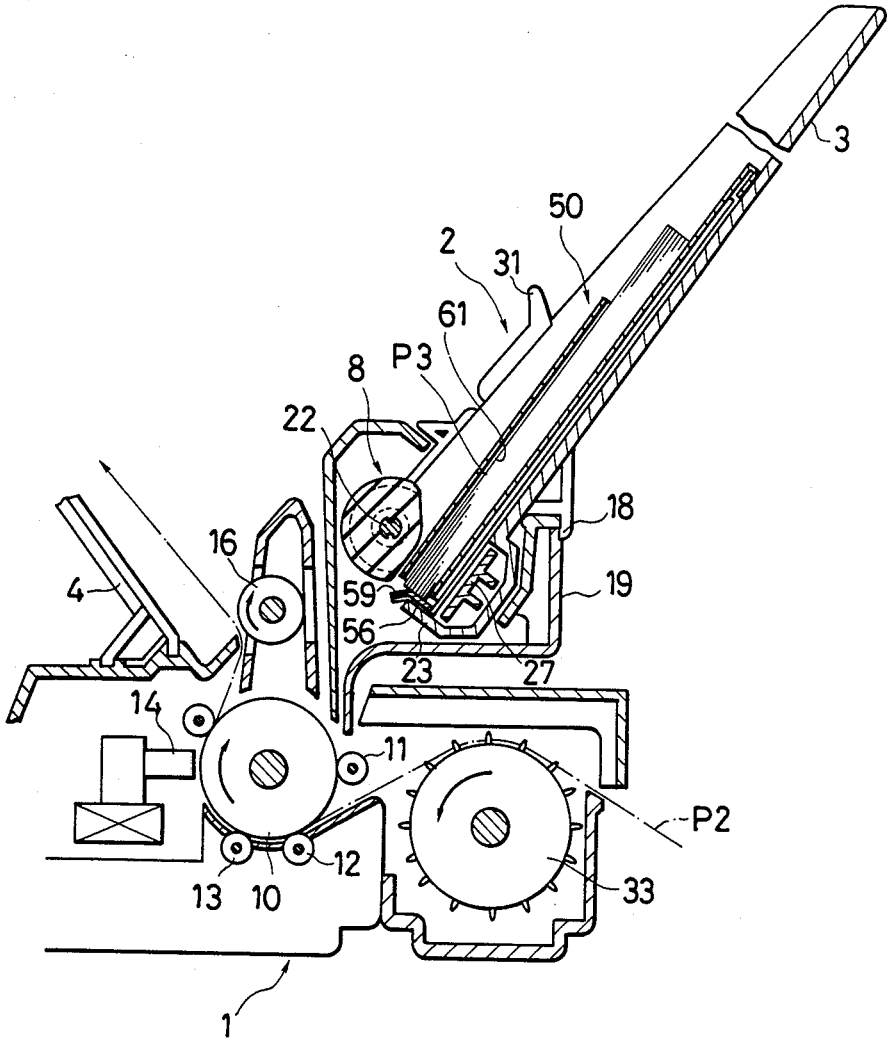
FIG. 12 is a vertical sectional view, similar to FIG. 5, showing a sheet feeding device according to a second embodiment of the invention, fitted with modified thick paper holder means.

In FIG. 12, a modified holder 50 for thick cut sheets, which is mounted on the supporting means 3, is in the course of feeding the thick cut sheets P3, instead of feeding the thin cut sheets.

The thick paper holder 50 is supported on the supporting pieces 23 of the supporting means 3, and the feed rollers 8 face the front end portion of the holder 50.

Figure 13:
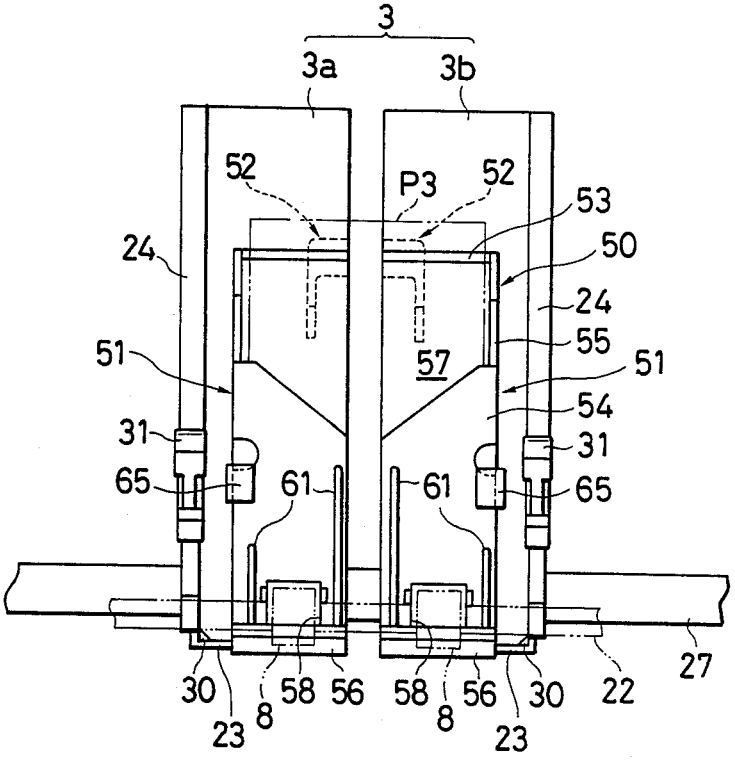
FIG. 13 is a partial front view, similar to FIG. 6, showing the thick paper holder means of FIG. 12.

As shown in FIG. 13, the thick paper holder 50 includes a pair of sheet receiving members 51, which correspond individually to the left and right paper holders 3*a* and 3*b* constituting the thin paper supporting means 3. The holder 50 is removably attached to the supporting means 3 by mounting means 52 mentioned later. Thus, the holder 50 can move along with the supporting means 3, in the transverse direction or across the sheets, for adjustment.

In the state shown in FIG. 3, the sheet receiving members 51 are located at a predetermined distance from the side plates 24 of their corresponding paper holders 3a and 3b, so that it never interferes with the separating claws or engaging pieces 30. The paired receiving members 51 cooperate with each other to hold the thick cut sheets P3 in a pile, as shown in FIG. 3.

Each sheet receiving memer 51 includes a bottom plate 53, a top plate 54, side plates 55 coupled integrally to the opposite side edges of the plates 53 and 54, and a supporting member 56 for retaining the leading ends of the thick cut sheets P3, with respect to the feeding direction. A backup member 57 is contained in each receiving member 51. The top plate 54 is formed with a window opening 58, on the front end side facing the supporting member 56. When the holder 50 is mounted on the supporting means 3, the paired feed rollers 8 can come into contact with the thick cut sheets P3 in the holder 50, through their corresponding window holes 58.

Figure 14:
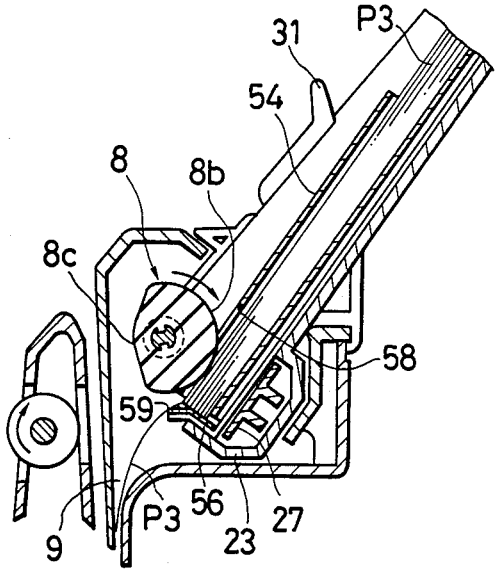
FIG. 14 is an enlarged view of a principal part of the sheet feeding device of FIG. 12, for illustrating the feeding operation of feed rollers.

As the feed rollers 8 rotate so that their operative surfaces come into contact with the uppermost thick cut sheet P3, as shown in FIG. 14, the sheet P3 slides on a slanting guide surface 59 of the supporting member 56, to be delivered to the feeding aperture 9.

Figure 15:
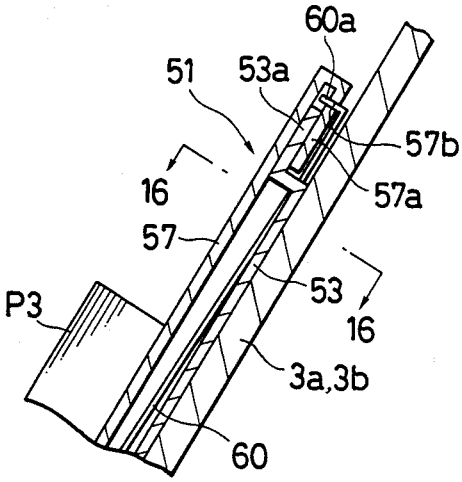
FIG. 15 is an enlarged view showing part of FIG. 12.
Figure 17:
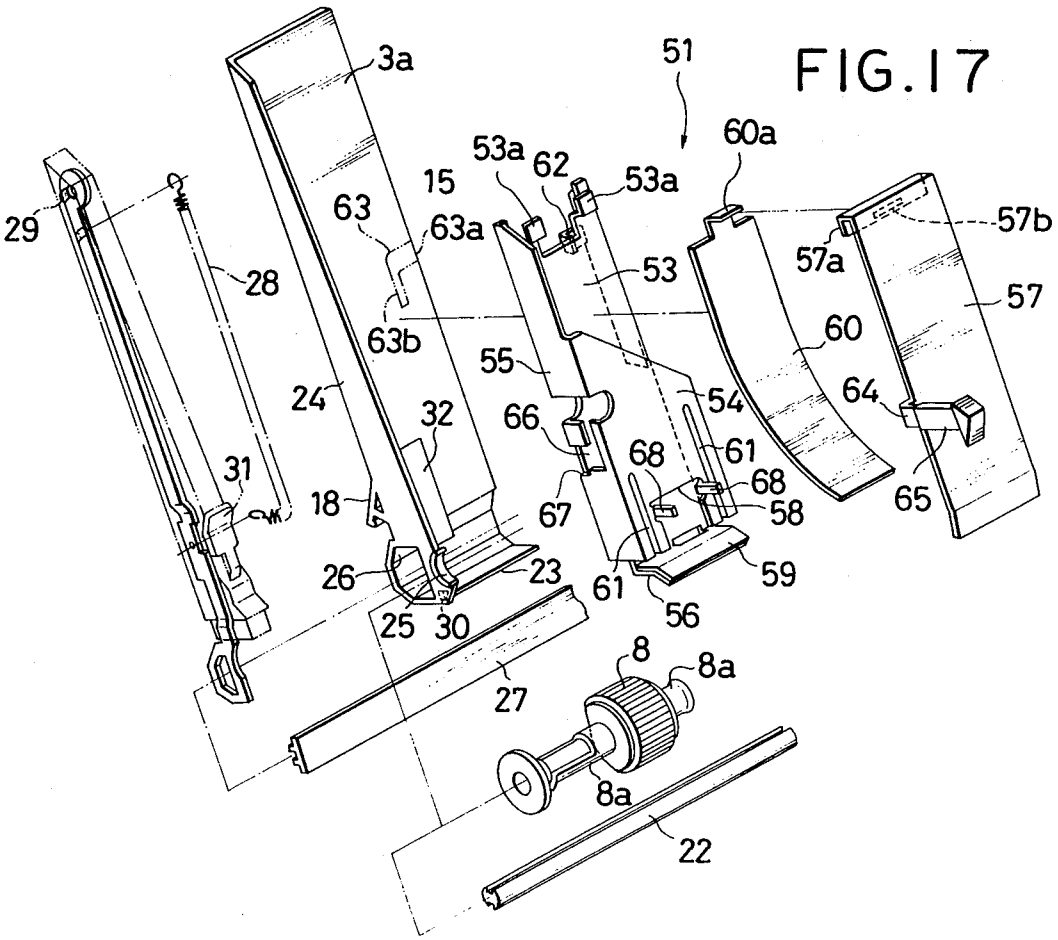
FIG. 17 is an exploded perspective view showing one sheet receiving member of the thick paper holder means, along with its corresponding thin paper holder.

In this case, by operating the operating lever 31, the backup member 27 for thin cut sheets is held in the nonoperative position where it does not press the sheet receiving members 51 toward the feed rollers 8. On the other hand, the backup members 57 in the receiving members 51 presses the thick cut sheets P3 toward the feed rollers 8. Each backup member 57 is urged by a leaf spring 60, as shown in FIGS. 15 and 17. The top plate 54 has a pair of guide ridges 61 which is formed on either side of the window hole 58 by pressing, so as to project inward and extend in the sheet feeding direction. The guide ridges 61 serve to prevent the uppermost thick cut sheet P3 from coming into plane contact with the inner surface of the top plate 54, thus facilitating smooth paper feed.

A U-shaped retaining portion 57*a*, formed at the rear or upper end portion of each backup member 57, as shown in FIG. 15, can slide across the sheets, while engaging a bent receiving portion 53*a* (FIG. 17) of its corresponding bottom plate 53. A proximal or upper end portion 60*a* of the leaf spring 60 is bent so as to be fitted in a mounting hole 57b formed in the retaining portion 57*a*. Thus, the bottom plate 53, backup member 57, and leaf spring 60 are coupled to one another.

Figure 16:
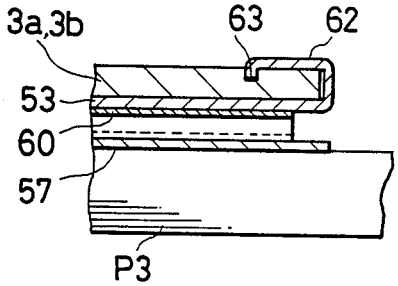
FIG. 16 is a partial sectional view taken along line 16—16 of FIG. 15.

As shown in FIG. 16, a bent engaging member 62 protrudes from the back of the bottom plate 53 of each sheet receiving member 51. As the engaging members 62 slidably engage engaging grooves 63, formed individually in the back of their corresponding paper holders 3*a* and 3*b*, the receiving members 51 are attached in position to the holders 3*a* and 3*b*, as shown in FIG. 13. The engaging members 62 and the engaging grooves 63 constitute the mounting means. This arrangement will be understood more fully from FIG. 17.

Although FIG. 17 shows only one of the sheet receiving members 51 and only the one paper holder 3*a*, their counterparts are arranged in like manner. In mounting the one receiving member 51 on its corresponding paper holder 3*a*, the engaging member 62 is slid horizontally or across the sheets, along a horizontal groove portion 63*a* of the engaging groove 63, and then along a vertical groove portion 63*b*. When the member 62 reaches the lower end of the groove portion 63*b*, it is locked and cannot be removed easily.

A hook member 64 and an operating member 65 are formed integrally on one side edge of each backup member 57, while the side plate of each sheet receiving member 51 is formed with an opening 66 and an engaging step portion 67.

In attaching the backup member 57, along with the leaf spring 60, to the sheet receiving member 51, the operating member 65 and the hook member 64 are first passed through the opening 66, from the inside of the member 51 to the outside. Then, the retaining portion 57*a* is caused to engage the receiving portion 53*a* its corresponding bottom plate 53.

If the backup member 57 is slid and depressed by handling the operating member 65, the hook member 64 engages the engaging step portion 67, so that the backup member 57 is held in a depressed position. Thus, the hook member 64 and the engaging step portion 67 constitute locking means for releasably holding the backup member 57 in the depressed position. When the backup member 57 is locked to the depressed position, the thick cut sheets P3 can be easily inserted into or taken out from the sheet receiving member 51.

A pair of projecting pieces 68 protrude outward from two opposite side edges of each window hole 58, individually. When the sheet receiving members 51 are attached to their corresponding paper holders 3a and 3*b*, the projecting pieces 68 come into contact with the boss portions 8*a* on either side of each corresponding feed roller 8, and are located on either side of the roller 8. Thus, the mounting position is stabilized, and the feed rollers 8 can be slid when the receiving members 51 are slid together with the paper holders 3*a* and 3*b*.

A sheet layer, formed of a high-friction material, such as felt, rubber, etc., is bonded to the inside of each supporting member 56 and each slanting guide surface 59, whereby the thick cut sheets P3 stacked in the thick paper holder 50 are prevented from slipping out unexpectedly.

Other members or portions shown in FIG. 17 are constructed in the same manner as their counterparts described in connection with the first embodiment.

According to the first and second embodiments of the present invention, as described above, the sheet feeding device is applied to a printer. It is to be understood, however, that the invention is not limited to those precise embodiments, may be applied also to copying machines and the like.

What is claimed is:

1. In a sheet feeding device including first paper holder means for supporting a member of first paper sheets in a pile, and feed roller means in contact with the uppermost one of the first paper sheets supported by the first paper holder means and rotatable so as to deliver the first paper sheets one by one in a sheet feeding direction from the first paper holder means, said first paper holder means including a pair of paper guide members slidable across the sheets, each said guide member having a side plate extending in the sheet feeding direction, said sheet feeding device further comprising:

second paper holder means for holding second paper sheets in a pile; and mounting means for detachably mounting the second paper holder means inside side plates on the pair of paper guide members, wherein said second paper sheets held by the second paper holder means, face the feed roller means so that the uppermost one of the second paper sheets comes into contact with the roller means, whereby the second paper sheets are delivered one by one when the second paper sheets are delivered one by one when the second paper holder means is mounted on the first paper holder means.

2. The sheet feeding device according to claim 1, further comprising:

backup means for urging the second paper sheets, held by the second paper holder means, to be in contact with the feed roller means;

said first paper sheet being a thin cut sheet, said first paper holder means including a claw piece engaging its corresponding corner portion of the uppermost thin cut sheets, on the leading end side thereof;

said claw piece allowing the one of the uppermost first thin sheets to be disengaged when the one of the thin cut sheets is delivered by the feed roller means, said second paper sheet being a thick cut sheet thicker than the first paper sheet;

said second paper holder means including a supporting member engaging the leading end of the uppermost thick cut sheets in the sheet feeding direction; and said supporting member having a guide surface formed thereon so as to extend across the sheets, whereby the leading end of the uppermost thick cut sheets is slid out from the second paper holder means as the feed rollers rotate, so that the thick cut sheets are delivered in the sheet feeding direction.

3. The sheet feeding device according to claim 1, wherein said guide surface is formed of a slanting surface leaning toward the feed roller means, with respect to the sheet feeding direction.

4. The sheet feeding device according to claim 1, wherein said guide surface is formed of a round surface formed on that end edge of the supporting member facing the feed roller means.

5. The sheet feeding device according to claim 1, wherein said backup means includes a backup member elongated across the sheets and movably supported by the first paper holder means, said backup member serving to urge the first paper sheets, supported by the first paper holder means, toward the feed roller means when the second paper holder means is not mounted on the first paper holder means.

6. The sheet feeding device according to claim 5, wherein said second paper holder means includes a parallel pair of side plates corresponding individually to two opposite side edges of each second paper sheet held thereby, and each having one end portion coupled to the supporting member, each said side plate being formed with a notch to allow the backup member of the backup means to be in contact with the second paper sheets held by the second paper holder means.

7. The sheet feeding device according to claim 6, wherein said second paper holder means further includes a coupling plate connected to the respective other end portions of said pair of side plates, thus constituting a rectangular frame, in conjunction with the side plates and the supporting member.

8. The sheet feeding device according to claim 7, wherein said second paper holder means further includes a guide plate extending between and parallel to said pair of side plates, and a cross member fixed to both the side plates and supporting the guide plate so as to be slidable across the sheets.

9. The sheet feeding device according to claim 1, wherein said mounting means includes a pair of press members slidable across the sheets, on the first paper holder means, and capable of being held in position by friction, said press members being located in positions close to their corresponding side portions of the second paper holder means, on the first paper holder means, so as to hold the second paper holder means between the press members, thereby restraining the second paper holder means from moving across the sheets, and wherein said second paper holder means is located so as not to interfere with the claw piece.

10. The sheet feeding device according to claim 9, wherein said first paper holder means includes a pair of paper guide members slidable across the sheets, each said guide member having a supporting piece extending across the sheets, and supporting and aligning the leading ends of the first paper sheets, stacked on the guide members, and a side plate extending in the sheet feeding direction and coupled to the supporting piece by means of a coupling portion; said claw piece is attached to the coupling portion; and said press member is attached to the side plate and, is slidable together with the paper guide member.

11. In a sheet feeding device comprising first paper holder means for supporting a number of thin cut first paper sheets in a pile, and feed roller means in contact with the uppermost one of the first paper sheets supported by the first paper holder means, and rotatable so as to deliver the first paper sheets one by one, in a sheet feeding direction, from the supporting means, said sheet feeding device further comprising:

second paper holder means for holding thick cut second paper sheets in a pile, said second paper sheets being thicker than said first paper sheets;

mounting means for detachably mounting the second paper holder means on the first paper holder means; and backup means for urging the second paper sheets, held by the second paper holder means, to be in contact with the feed roller means, said first paper holder means including a claw piece engaging its corresponding corner portion of the uppermost one of the first paper sheets, on the leading end side thereof, and a pair of paper guide members slidable across the sheets, each said guide member having a supporting face extending across the sheets, and supporting and aligning the leading ends of the first paper sheets, stacked on the guide members, and a side plate extending in the sheet feeding direction and coupled to the supporting piece by means of a coupling portion, said claw piece being attached to the coupling portion allowing the one of the uppermost first paper sheets to be disengaged when the one of the first paper sheets is delivered by the feed roller means, second paper holder means being mounted on such a portion of the first paper holder means that the second paper holder means does not interfere with the claw piece, said second paper holder means including a pair of sheet receiving members corresponding individually to said pair of paper guide members, and slidable together with the guide members, and a supporting member engaging the leading end of the other of the uppermost one of the second paper sheets in the sheet feeding direction, said supporting member having a guide surface formed thereon so as to extend across the sheets, whereby the leading end of the other of the uppermost first and second paper sheets is slid out from the other of the first and second paper holder means as the feed rollers rotate, so that the other of the first and second sheets is delivered in the sheet feeding direction.

12. The sheet feeding device according to claim 11, wherein each said sheet receiving member of the second paper holder means includes a bottom plate supporting the thick cut sheets as the second paper sheets, a top plate, and a side plate coupling the bottom and top plates, and said backup means includes a backup plate disposed between the top and bottom plates and connected, at one end portion thereof, to the bottom plate, and a leaf spring interposed between the backup plate and the bottom plate.

13. The sheet feeding device according to claim 12, wherein said mounting means includes engaging members provided on the respective bottom plates of their corresponding sheet receiving members, and engaging grooves formed individually in the guide members corresponding to the receiving members, said engaging members being slidably fitted in the engaging grooves, so that the sheet receiving members move together with their corresponding guide members, across the sheets.

14. The sheet feeding device according to claim 13, wherein said supporting member is formed by bending the end portion of the bottom plate substantially at right angles, and said guide surface is formed of a slanting surface.

15. The sheet feeding device according to claim 14, wherein a window hole is formed in that region of said top plate corresponding to the supporting member, so that said feed roller means comes into contact with the thick cut sheets as the second paper sheets, held by the sheet receiving members, through the window hole.

16. The sheet feeding device according to claim 12, wherein each said sheet receiving member includes locking means for releasably holding the backup plate, against the urging force of the leaf spring, in a depressed position to permit insertion of the thick cut sheets, and an operating member used to depress the backup plate.

17. The sheet feeding device according to claim 16, wherein said locking means includes a hook piece provided on one side of the backup plate, and a notched step portion formed on the side plate so as to engage the hook piece, said operating member being attached to the backup plate.

* * * * *

UNITED STATES PATENT AND TRADEMARK OFFICE

CERTIFICATE OF CORRECTION

PATENT NO. : 4,838,535

DATED : June 13, 1989

INVENTOR(S) : Takeshi Yokoi and Toshiki Morita

It is certified that error appears in the above-identified patent and that said Letters Patent is hereby corrected as shown below:

Claim 1, column 8, line 61, between "inside" and "side" insert --said--;

line 68, "sheets are delivered one by" should be deleted; and

Column 9, line 1, delete "one when the second paper".

Signed and Sealed this

Twenty-second Day of May, 1990

*Attest:*

HARRY F. MANBECK, JR.

*Attesting Officer*

*Commissioner of Patents and Trademarks*